US008496192B2

(12) United States Patent
Mancini et al.

(10) Patent No.: US 8,496,192 B2
(45) Date of Patent: Jul. 30, 2013

(54) OUTWARD OPENING FUEL INJECTOR

(75) Inventors: Luca Mancini, Budrio (IT); Michele Petrone, San Lazzardo di Savena (IT); Marcello Cristiani, Imola (IT)

(73) Assignee: Magneti Marelli Powertrain, S.p.A., Corbetta (IT)

( * ) Notice: Subject to any disclaimer, the term of this patent is extended or adjusted under 35 U.S.C. 154(b) by 0 days.

(21) Appl. No.: 13/047,010

(22) Filed: Mar. 14, 2011

(65) Prior Publication Data

US 2011/0163189 A1 Jul. 7, 2011

Related U.S. Application Data

(62) Division of application No. 12/150,639, filed on Apr. 30, 2008, now Pat. No. 7,980,492.

(30) Foreign Application Priority Data

Apr. 30, 2007 (EP) ..... 07425255

(51) Int. Cl.
*F02M 63/00* (2006.01)
*F02M 61/08* (2006.01)
*F02M 61/20* (2006.01)

(52) U.S. Cl.
USPC ..... 239/533.7; 239/533.9; 123/447

(58) Field of Classification Search
USPC ..... 239/533.7, 533.1, 533.2, 533.9; 123/299, 123/446, 447, 467, 468
See application file for complete search history.

(56) References Cited

U.S. PATENT DOCUMENTS

| | | | | |
|---|---|---|---|---|
| 1,755,192 | A | 4/1930 | Lane | 239/533.7 |
| 3,450,353 | A | 6/1969 | Eckert | 239/585.2 |
| 4,624,625 | A * | 11/1986 | Schrenker | 417/20 |
| 4,844,339 | A * | 7/1989 | Sayer et al. | 239/5 |

(Continued)

FOREIGN PATENT DOCUMENTS

| | | |
|---|---|---|
| DE | 3 834 446 | 4/1990 |
| EP | 1 717 437 | 2/2006 |
| EP | 1 734 251 | 12/2006 |
| WO | WO 9004098 | 4/1990 |

OTHER PUBLICATIONS

European Search Report dated Feb. 21, 2008 in the corresponding European Application No. 07425255.

(Continued)

*Primary Examiner* — Len Tran
*Assistant Examiner* — Justin Jonaitis
(74) *Attorney, Agent, or Firm* — Ohlandt, Greeley, Ruggiero and Perle, L.L.P.

(57) ABSTRACT

A fuel injector provided with: an injection valve comprising an injection nozzle; a mobile needle for regulating the fuel flow through the injection valve and ending with a shutting head, which engages a valve seat of the injection valve, is arranged externally with respect to injection valve and presents a predetermined sealing diameter; an actuator for displacing the needle between a closing position and an opening position of the injection valve; a closing spring which tends to maintain the needle in the closing position of the injection valve pushing the shutting head against the valve seat itself in a sense contrary to the feeding sense of the fuel; and a supporting body having a tubular shape and presenting a feeding channel within which a needle is arranged; the needle, at an opposite end of the shutting head, is coupled to a balancing channel, which is at ambient pressure.

22 Claims, 4 Drawing Sheets

U.S. PATENT DOCUMENTS

| | | | | |
|---|---|---|---|---|
| 5,024,202 | A | 6/1991 | McKay | 123/533 |
| 5,190,223 | A | 3/1993 | Mesenich | 239/585.5 |
| 5,400,970 | A * | 3/1995 | Alt et al. | 239/408 |
| 6,561,436 | B1 | 5/2003 | Boecking | 239/102.2 |
| 6,592,052 | B2 * | 7/2003 | Hokao | 239/135 |

OTHER PUBLICATIONS

English translation of Chinese Office Action dated Jun. 22, 2011 for corresponding Chinese Application No. 200810094471.8.

* cited by examiner

OUTWARD OPENING FUEL INJECTOR

CROSS REFERENCE TO RELATED PATENT APPLICATIONS

This application is a divisional of U.S. application Ser. No. 12/150,639, filed Apr. 30, 2008 now U.S. Pat. No. 7,980,492, which claims the benefit of European Patent Application No. 07425255.2, filed Apr. 30, 2007. U.S. application Ser. No. 12/150,639, filed Apr. 30, 2008 is hereby incorporated herein by reference in its entirety.

TECHNICAL FIELD

The present invention relates to an outward opening fuel injector.

The present invention finds advantageous application in an electromagnetic injector, to which explicit reference will be made in the following description without because of this loosing in generality.

BACKGROUND ART

An electromagnetic fuel injector comprises a cylindrical tubular accommodation body presenting a central feeding channel, which performs the function of fuel pipe and ends with an injection nozzle regulated by an injection valve controlled by an electromagnetic actuator. The injection valve is provided with a needle, which is rigidly connected to a mobile keeper of the electromagnetic actuator to be displaced by the bias of the electromagnetic actuator itself between a closing position and an opening position of the injection nozzle against the bias of a closing spring which tends to maintain the needle in the closing position. The needle ends with a shutting head, which in the closing position is pushed by the closing spring against the valve seat of the injection valve to prevent the output of fuel. Generally, the shutting head is arranged inside the fuel pipe and consequently, to pass from the closing position to the opening position of the injection valve, the shutting head is displaced in a sense contrary to the feeding sense of the fuel remaining within the fuel pipe; these fuel injectors are named inward opening fuel injectors.

Inward opening fuel injectors cannot ensure a high precision and a high stability in the fuel injection direction and thus are not suitable for being used in the so-called "spray-guided" engines which use a stratified combustion, in which the fuel must be injected with a very high precision near the spark plug; indeed, in this type of application an error of less than one millimeter in the fuel flow direction may wet the spark plug electrodes and thus seriously compromise combustion.

In order to obtain a high precision and a high stability in the fuel injection direction, outward opening fuel injectors are used, in which the shutting head presents a truncated-cone shape, is arranged outside the fuel pipe, is pushed by a closing spring against the valve seat of the injection valve itself with a sense contrary to the feeding sense of the fuel, and is consequently displaced from the closing position to the opening position in a sense agreeing with the feeding sense of the fuel.

In order to obtain optimal features of the fuel injection, the hydraulic sealing diameter of the truncated-cone shaped shutting head is high and in the order of 3.5-4 mm instead of 1.3-1.5 mm of a head of the standard ball shutter. When the engine is running, high-pressure fuel (about 150-200 bars) is present inside the feeding pipe, which fuel generates a hydraulic opening thrust of considerable proportions on the shutting head by effect of the large hydraulic sealing area; such hydraulic opening thrust on the shutting head must be contrasted by the closing force of the closing spring which must be consequently dimensioned to generate a considerable elastic closing force. Consequently, also the electromagnet must be dimensioned to be capable of generating a considerable electromagnetic opening force higher than the elastic closing force of the closing spring to allow to start the engine; indeed, when the engine has started, the elastic closing force generated by the closing spring is contrasted by the hydraulic opening thrust generated by the pressurised fuel, while the hydraulic opening thrust generated by the pressurised fuel is generally absent when starting the engine (the high pressure fuel pump is mechanically actuated by the crankshaft and thus static before the engine is started).

Dimensioning both the closing spring and the electromagnet for respectively generating an elastic force and an electromagnetic force of high intensity implies high production costs and heavy weights which determine considerable mechanical and magnetic inertia with consequent worsening of the dynamic performances of the injector (i.e. reduction of the actuation speed); the worsening of the dynamic performances of the injector is particularly negative, because it prevents actuating the injector for short injections and thus prevents the performance of short pilot injections before the main injection.

In order to solve the aforesaid drawbacks, it has been suggested to replace the traditional electromagnetic actuator with a piezoelectric actuator, which is adapted to generate very high piezoelectric forces with very short actuation times. However, a piezoelectric actuator is currently very costly and difficult to make.

DISCLOSURE OF INVENTION

It is the object of the present invention to make an outward opening fuel injector which is free from the above-described drawbacks and is specifically easy and cost-effective to make.

According to the present invention, there is made an outward opening fuel injector as claimed in the attached claims.

BRIEF DESCRIPTION OF THE DRAWINGS

The present invention will now be described with reference to the accompanying drawings, which illustrate some non-limitative embodiments thereof, in which.

BEST MODE FOR CARRYING OUT THE INVENTION

Figure 1:
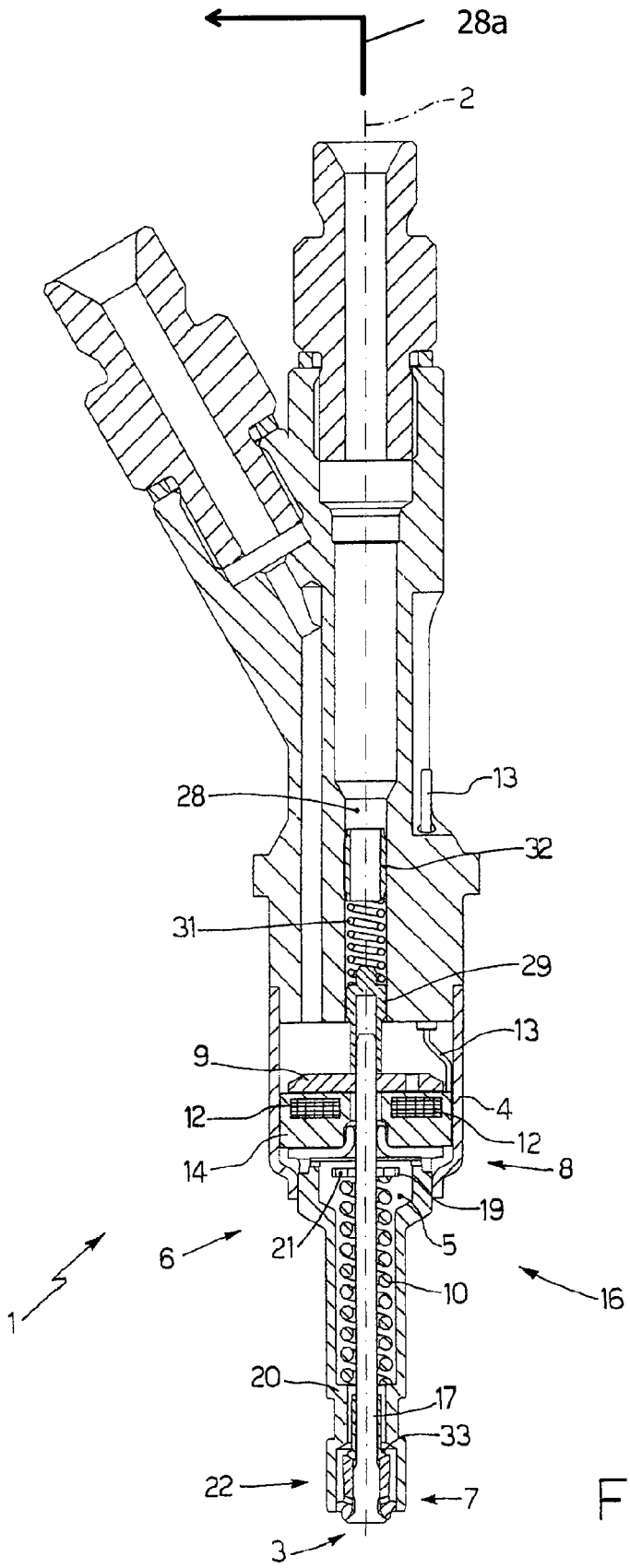
FIG. 1 is a diagrammatic, side section view with parts removed for clarity of a fuel injector made according to the present invention.

In FIG. 1, number 1 indicates as a whole a fuel injector, which presents an essentially cylindrical symmetry about a longitudinal axis 2 and is controlled to inject fuel from an injection nozzle 3 (shown in FIG. 2) which leads directly into a combustion chamber (not shown) of a cylinder. Injector 1 comprises a supporting body 4, which has a variable section cylindrical tubular shape along longitudinal axis 2 and presents a feeding channel 5 extending along its entire length to feed the pressurised fuel to injection nozzle 3. Supporting body 4 accommodates an electromagnetic actuator 6 at an upper portion thereof and an injection valve 7 (shown in FIG. 2) at a lower portion thereof; in use, injection valve 7 is actuated by electromagnetic actuator 6 to adjust the fuel flow through injection nozzle 3, which is obtained at injection valve 7 itself.

Figure 3:
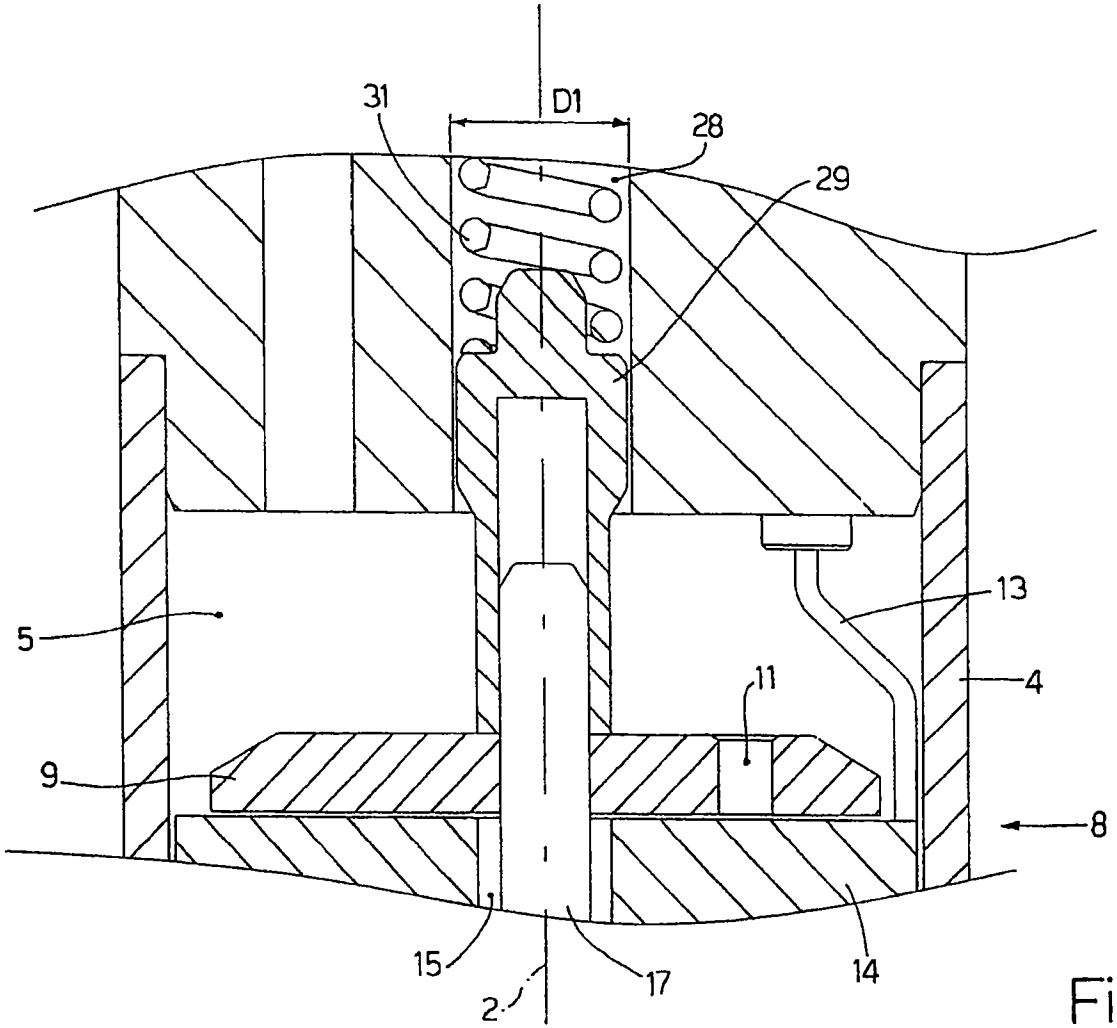
FIG. 3 shows an electromagnetic actuator of the injector in FIG. 1 on a magnified scale.
Figure 4:
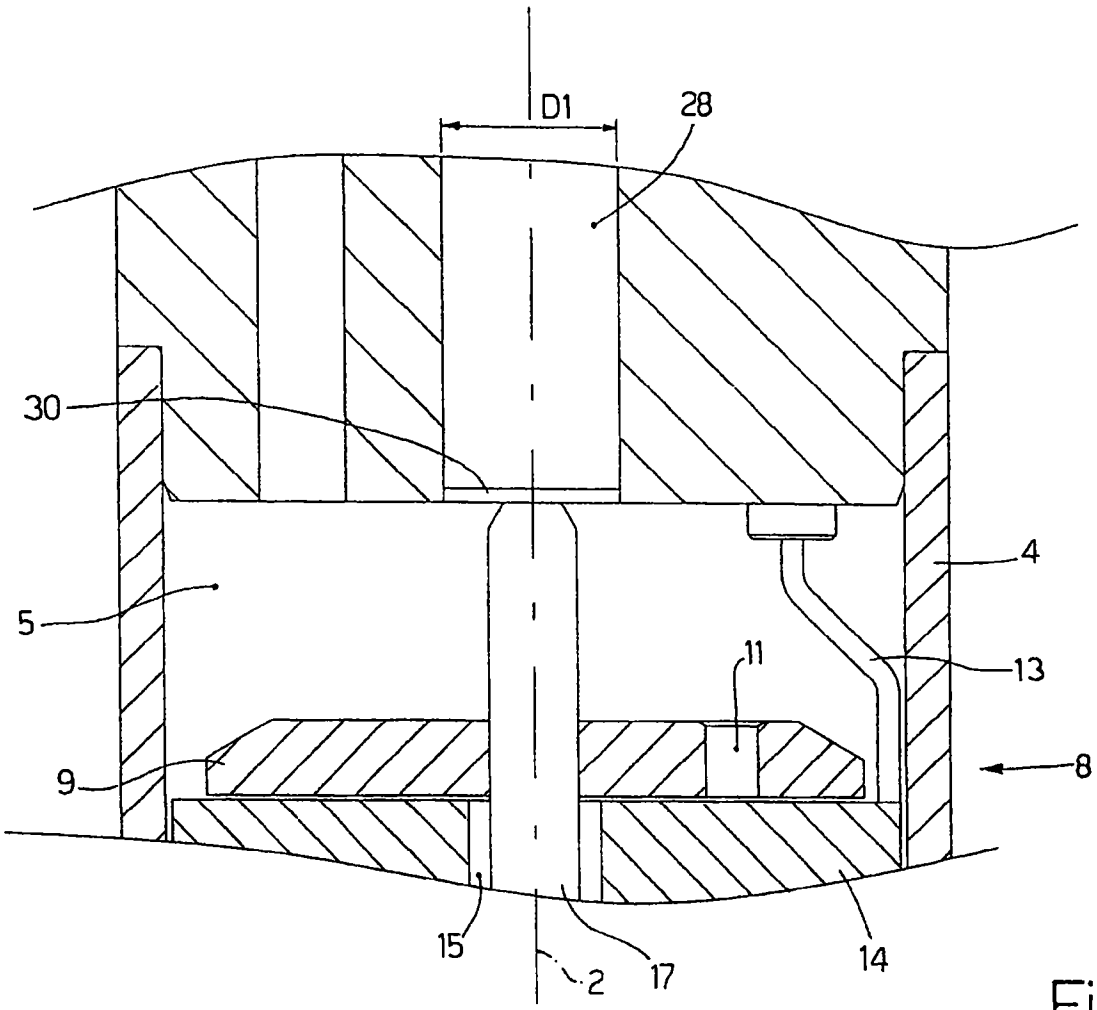
FIG. 4 shows a variant of the electromagnetic actuator in FIG. 3.

Electromagnetic actuator 6 comprises an electromagnet 8, which is accommodated in fixed position within supporting body 4 and when energised displaces a ferromagnetic material keeper 9 along axis 2 from a closing position to an opening position of injection valve 7 against the bias of a closing spring 10 which tends to maintain mobile keeper 9 in the closing position of injection valve 7. Mobile keeper 9 presents a plurality of axial through holes 11 (only one of which is shown in FIGS. 3 and 4) to allow the fuel flow towards injection nozzle 3. Electromagnet 8 further comprises a coil 12 which is electrically powered by an electronic control unit (not shown) by means of an electric wire 13 and is embedded in a fixed magnetic yoke 14, which is accommodated inside supporting body 4 and presents a central hole 15 for allowing the fuel flow towards injection nozzle 3.

Preferably, fixed magnetic yoke 14 of electromagnet 8 accommodates therein two coils 12 electrically independent from each other (not shown in detail). The main advantage of the use of an electromagnet 8 of the "multipolar stator" type is related to the fact that such electromagnet 8 is extremely fast, presenting a very low magnetic material mass and consequently a very low mechanical and magnetic inertia.

Mobile keeper 9 is part of a mobile equipment 16, which further comprises a shutter or needle 17, having an upper portion integral with mobile keeper 9 and a lower portion cooperating with a valve seat 18 (shown in FIG. 2) of injection valve 7 to adjust the fuel flow through injection nozzle 3 in the known way. A matching ring 19 is fixed to needle 17, which ring compresses closing spring 10 against a shoulder 20 of supporting body 4 so that closing spring 10 tends to keep mobile keeper 9 (i.e. needle 17) in the closing position of injection valve 7. Matching ring 19 presents a plurality of axial through holes 21 for allowing the fuel flow towards injection nozzle 3.

Figure 2:
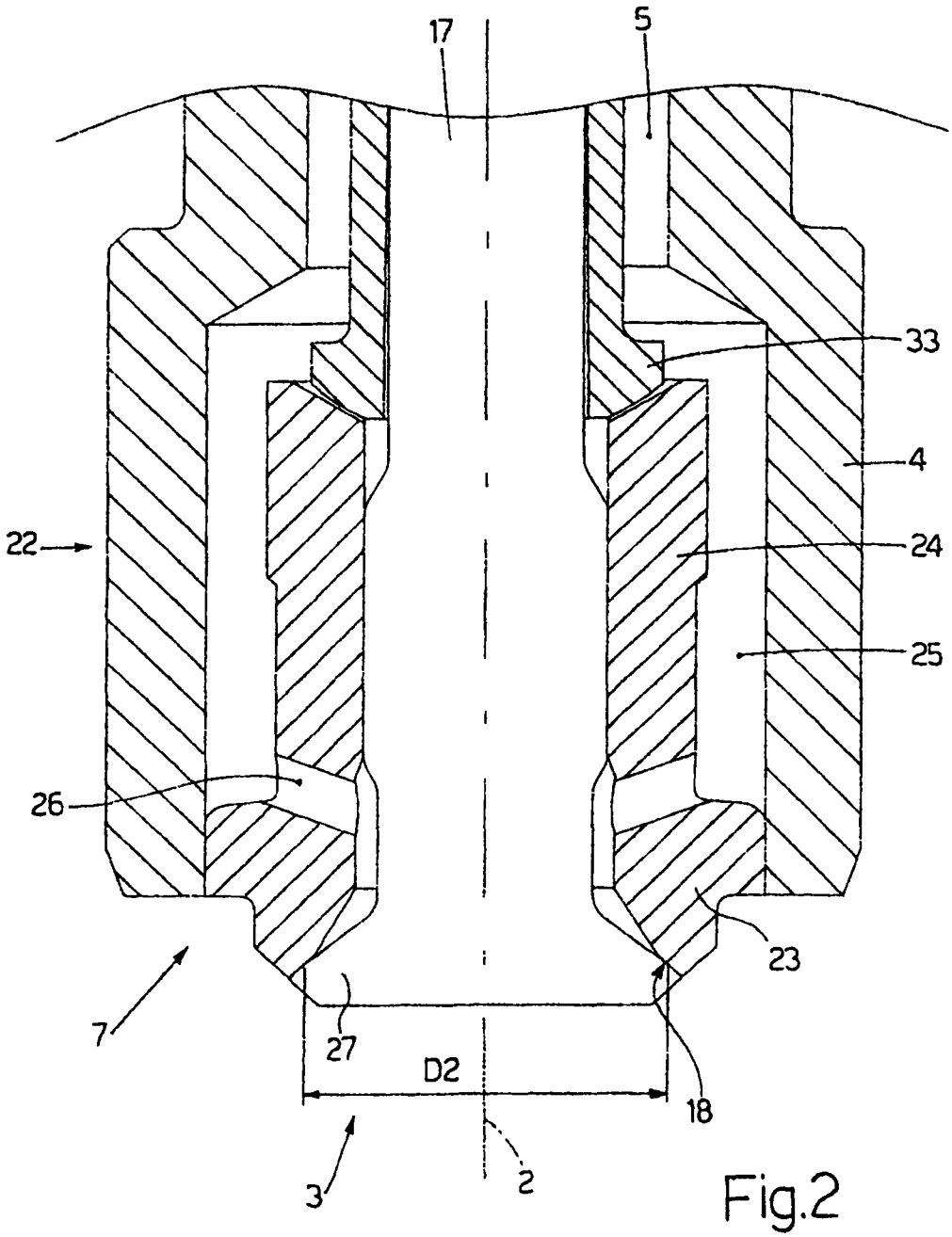
FIG. 2 shows an injection valve of the injector in FIG. 1 on a magnified scale.

As shown in FIG. 2, valve seat 18 presents a truncated-cone shape and is defined in a sealing body 22, which is monolithic and comprises a disc-shaped capping element 23, which inferiorly and fluid-tightly closes feeding channel 5 of supporting body 4 and is crossed by injection nozzle 3. A guiding element 24 rises from capping element 23, which guiding element has a tubular shape, accommodates therein a needle 17 for defining a lower guide of the needle 17 itself and presents an external diameter smaller than the internal diameter of feeding channel 5 of supporting body 4, so as to define an external annular channel 25 through which the pressurised fuel may flow.

According to a different embodiment (not shown), guiding element 24 superiorly presents a diameter equal to the internal diameter of feeding channel 5 of supporting body 4; millings (typically two or four and symmetrically distributed) are made in the upper part of guiding element 24 for feeding fuel to annular channel 25.

Four through holes 26 (only one of which is shown in FIG. 2), which lead towards valve seat 18 to allow the pressurised fuel flow towards valve seat 18 itself, are obtained in the lower part of guiding element 24. Through holes 26 may preferably be offset with respect to longitudinal axis 2 so as not to converge towards longitudinal axis 2 itself and to impress a vortical pattern to the corresponding fuel flows in use; alternatively, through holes 26 may converge towards longitudinal axis 2. As shown in FIG. 2, holes 26 from an angle of approximately 60° with longitudinal axis 2; according to a different embodiment (not shown), holes 26 form a 90° angle with longitudinal axis 2.

Needle 17 ends with a truncated-cone-shaped shutting head 27, which is adapted to fluid-tightly rest against valve seat 18 presenting a truncated-cone shape which negatively reproduces the truncated-cone shape of shutting head 27 itself. It is important to observe that shutting head 27 is arranged externally to guiding element 24 and is pushed by closing spring 10 against guiding element 24 itself; consequently, in order to pass from the closing position to the opening position of injection valve 7, shutting head 27 is displaced along longitudinal axis 2 downwards, i.e. with a sense agreeing with the feeding sense of the fuel.

In the opening position of injection valve 7, shutting head 27 is separated by valve seat 18 creating a passage opening of the fuel having a circular-crown-shaped section and a truncated-cone shape; consequently, the fuel which is injected through injection nozzle 3 presents an internally hollow conical shape having an opening angle essentially identical to the opening angle of shutting head 27 (corresponding exactly to the opening angle of valve seat 18).

As shown in FIGS. 1 and 3, injector 1 comprises a balancing channel 28, which is at ambient pressure, is coaxial to longitudinal axis 2, originates from feeding channel 5, and ends in a fuel recirculation pipe 28*a* at ambient pressure which feeds the fuel into a fuel tank at ambient pressure. Needle 17, at an opposite end of shutting head 27, is coupled to balancing channel 28, which is at ambient pressure. According to a preferred embodiment, balancing channel 28 presents an internal diameter D1 equal to sealing diameter D2 of shutting head 27.

According to the embodiment shown in FIGS. 1 and 3, needle 17, at the opposite end of shutting head 27, is provided with a closing piston 29, which is inserted in balancing channel 28 so as to slide along balancing channel 28 itself. Furthermore, closing piston 29 presents a maximum external diameter essentially equal to internal diameter D1 of balancing channel 28 (actually slightly smaller to allow the sliding of closing piston 29 along balancing channel 28).

Necessarily the maximum diameter of closing piston 29 is slightly smaller than internal diameter D1 of balancing channel 28 to allow the sliding of closing piston 29 along balancing channel 28, and inevitably fuel leaks from between an internal wall of balancing channel 28 and an external wall of closing piston 29 and is recovered by the recirculation pipe.

According to a variant shown in FIG. 4, balancing channel 28 is hydraulically isolated from feeding channel 5 by means of an elastic diaphragm 30 on which the end of needle 17 opposite to shutting head 27 rests. For example, diaphragm 30 is formed by elastic spring steel so as to present a high elastic deformation capacity. Preferably, diaphragm 30 is laterally welded to the walls of balancing channel 28 and is centrally welded to the end of needle 17 opposite to shutting head 27. In virtue of the fact that balancing channel 28 is hydraulically isolated from feeding channel 5, there is no leakage of fuel into balancing channel 28 and thus the presence of the recirculation pipe is not necessary.

When pressurised fuel is fed inside feeding channel 5 and injection valve 7 is in the closing position, a first hydraulic thrust is generated on needle 17 by the pressurised fuel at valve seat 18, which thrust tends to open injection valve 7, and a second hydraulic thrust is generated by the pressurised fuel at balancing channel 28 which tends to maintain injection valve 78 closed. The first hydraulic thrust generated by the pressurised fuel at valve seat 18 is equal to the pressure difference astride injection valve 7 multiplied by the sealing area (depending on the sealing diameter D2 of shutting head 27); the second hydraulic thrust generated by the pressurised fuel at balancing channel 28 is equal to the pressure difference between feeding channel 5 and balancing channel 28 multiplied by the area of balancing channel 28 (according to the internal diameter D1 of balancing channel 28). Being the internal diameter D1 of balancing channel 18 identical to sealing diameter D2 of shutting head 27 and being the pressure difference astride injection valve 7 essentially equal to the pressure difference between feeding channel 5 and balancing channel 28, the hydraulic thrusts are reciprocally opposite and essentially identical and thus reciprocally compensated when injection valve 7 is in the closing position. Consequently, in order to maintain injection valve 7 in the closing position closing spring 10 must generate a modest elastic force not needing to overcome appreciable thrusts of hydraulic nature; therefore closing spring 10 may be dimensioned to generate an elastic closing force of contained entity. Similarly, also electromagnetic shutter 6 may be dimensioned to generate an electromagnetic opening force of contained entity.

According to a preferred embodiment shown in FIG. 1, a further calibration spring 31 is contemplated, which is arranged along balancing channel 28 and is compressed between the end of needle 17 opposite to shutting head 27 and a tubular matching body 32 driven in fixed position inside balancing channel 28; specifically, calibration spring 31 presents an upper end resting on a lower wall of matching body 32 and a lower end resting on a protuberance of closing piston 29. Calibration spring 31 exerts an elastic force on needle 17 having opposite sense with respect to the elastic force of closing spring 10; during the assembly of injector 1, the position of matching body 32 is adjusted so as to consequently adjust the elastic force generated by calibration spring 31 so as to calibrate the total elastic thrust on needle 17.

As shown in FIG. 2, the lower part of needle 17 comprises a stopper element 33, which is integral with needle 17 and is adapted to abut against an upper surface of guiding element 24 when needle 17 is in the opening position of injection valve 7 by effect of the thrust generated on the needle 17 itself of electromagnet 8 so as to determine the stroke length of needle 17. The axial dimension (i.e. along longitudinal axis 2) of the air gap existing between mobile keeper 9 and fixed magnetic yoke 14 is established beforehand so as to always be higher than the stroke length of needle 17; in this manner, it is always guaranteed that the stroke length is determined by the abutment of stopper element 33 against guiding element 24 and not by the abutment of mobile keeper 9 against fixed magnetic yoke 14.

From the above, it is apparent that the air gap existing between mobile keeper 9 and fixed magnetic yoke 14 is never cancelled out, because mobile keeper 9 never comes into contact with fixed magnetic yoke 14; obviously during the step of designing the electromagnetic 8, the influence of the air gap which presents a larger dimension with respect to a traditional electromagnetic injector must be taken into consideration.

The fact that the stroke length of needle 17 is determined by the abutment of stopper element 33 allows to eliminate or reduce to marginal and negligible values the negative effects on the stroke length of needle 17 induced by the differences in the thermal expansions of needle 17 and supporting body 4. Such result is obtained in virtue of the fact that the stroke length of needle 17 is only affected by the position of stopper element 33 with respect to guiding element 24 and consequently the stroke length of needle 17 is subjected to variations only by effect of the possible differences of thermal expansion of the lower part of needle 17 with respect to the guiding element 24. The lower part of needle 17 presents a shorter total axial length than the upper part of needle 17, and thus also the thermal expansions of the lower part of needle 17 are reduced; furthermore, the lower part of needle 17 is nearly completely in direct contact with guiding element 24 and guiding element 24 is entirely wet by the fuel, therefore the lower part of needle 17 and the guiding element 24 essentially present the same temperature and thus the same thermal expansions.

Mobile keeper 9 of electromagnet 8 has an annular shape having a smaller diameter than the internal diameter of the corresponding position of feeding channel 5 of supporting body 4, and consequently mobile keeper 9 cannot also perform the upper guiding function of needle 17. According to the embodiment shown in FIG. 1, needle 17 is superiorly guided by closing piston 19, which is slidingly inserted inside balancing channel 28.

In use, when electromagnet 8 is de-energised, mobile keeper 9 is not attracted by fixed magnetic yoke 14 and the elastic force of closing spring 10 pushes mobile keeper 9 upwards along with needle 17; in this situation, shutting head 27 of needle 17 is pressed against valve seat 18 of injection valve 7, preventing the output of fuel. When electromagnetic 8 is energised, mobile keeper 9 is magnetically attracted by fixed magnetic yoke 14 against the elastic force of closing spring 10 and mobile keeper 9 along with needle 17 is displaced downwards until stopper element 33 abuts against guiding element 24; in this situation, mobile keeper 9 is separate from fixed magnetic yoke 14, shutting head 27 of needle 17 is lowered with respect to valve seat 18 of injection valve 7, and the pressurised fuel may flow through injection nozzle 3.

As previously mentioned, the four through holes 26 which lead towards valve seat 18 are preferably offset with respect to longitudinal axis 2 so as not to converge towards longitudinal axis 2 itself and impress a vortical pattern to the corresponding fuel flows in use. Such vortical pattern of the fuel immediately upstream of valve seat 18 allows to obtain a homogenous and uniform distribution of the fuel along the entire circumference avoiding the formation of "empty" zones, i.e. of zones in which a smaller amount of fuel is present.

When shutting head 27 of needle 17 is raised with respect to valve seat 18, the fuel reaches the chamber of injection nozzle 3 through external annular channel 25 and then crosses the four through holes 26; in other words, when shutting head 27 of needle 17 is raised with respect to valves seat 18, the fuel reaches injection chamber 25 of injection nozzle 3 lapping on the entire external side surface of guiding element 24. In this manner, guiding element 24 is constantly cooled by the fuel, which presents a relatively modest temperature; such cooling effect of guiding element 24 is transmitted to the entire sealing body 22 (which is monolithic) and is thus also transmitted to capping element 23 in which injection nozzle 3 is obtained. In other words, guiding element 24 constantly wet on the inside and the outside by fuel behaves as a radiator for dissipating the heat received from the outside and present in capping element 23.

Experimental tests have proven that the reduction of working temperature of capping element 23 determines a considerable reduction of the formation of scaling on the external surface of capping element 23 and thus near valve seat 18. In virtue of such reduction effect of the formation of scaling near valve seat 18, the above-described injector 1 presents a very long operative life.

The above-described injector 1 presents a number of advantages, because it is simple and cost-effective to produce and presents a high sealing diameter D2 and at the same time offers high dynamic performances (i.e. a high actuation speed of needle 17) which allows to perform pilot injections before the main injection.

What is claimed is:

1. A fuel injector comprising:

an injection valve comprising an injection nozzle;

a mobile needle for regulating a fuel flow through the injection valve and ending with a shutting head, the shutting head for engaging a valve seat of the injection valve and being arranged externally with respect to the injection valve and presenting a predetermined sealing diameter;

an actuator for displacing the needle between a closing position and an opening position of the injection valve;

a closing spring which maintains the mobile needle in the closing position of the injection valve, for pushing the shutting head against the valve seat in a sense contrary to a feeding sense of the fuel;

a supporting body having a tubular shape and presenting a feeding channel within which the mobile needle is arranged and in which fuel is fed at high pressure; and a balancing channel, at ambient pressure, being coupled to the mobile needle and hydraulically isolated from the feeding channel by an elastic diaphragm, the mobile needle having an end opposite to the shutting head that rests on the elastic diaphragm, wherein the balancing channel presents an internal diameter equal to the sealing diameter of the shutting head and the elastic diaphragm is laterally welded to walls of the balancing channel, the elastic diaphragm having a diameter equal to the sealing diameter of the shutting head; and a sealing body where the valve seat of the injection valve is defined for fluid-tightly closing the feeding channel, wherein the sealing body comprises a disc-shaped capping element that fluid-tightly closes the feeding channel, and a guiding element that elevates from the disc-shaped capping element, the disc-shaped capping element having a tubular shape and accommodates the mobile needle therein.

2. An injector according to claim 1, wherein the elastic diaphragm is formed by elastic steel.

3. An injector according to claim 1, wherein the elastic diaphragm is centrally welded to the end of the mobile needle opposite the shutting head.

4. An injector according to claim 1, wherein the shutting head is a truncated-cone shape, and wherein the valve seat is a truncated-cone shape that negatively reproduces the truncated-cone shape of the shutting head.

5. An injector according to claim 1, further comprising a stopper component that is integral with the mobile needle and abuts against an upper surface of the sealing body when the mobile needle is in the opening position of the injection valve to determine a stroke length of the mobile needle.

6. An injector according to claim 5, wherein the stopper element of the mobile needle abuts against an upper surface of the guiding element when the mobile needle is in the opening position of the injection valve.

7. An injector according to claim 6, wherein the guiding element at least partially presents a lower external diameter with respect to the internal diameter of the feeding channel to define an external channel for the fuel, and wherein the guiding element has in a lower part with -a number of through holes leading towards the valve seat.

8. An injector according to claim 5, wherein the actuator is of an electromagnetic type and comprises at least one coil, at least one fixed magnetic yoke, and at least one mobile keeper that is magnetically attracted by the fixed yoke against a force of a closing spring and is mechanically connected to the mobile needle, the injector further comprising an axial dimension of an air gap existing between the mobile keeper and the fixed magnetic yoke to always be larger than the stroke length of the mobile needle to ensure that the stroke length is determined by the abutment of the stopper element against the guiding element and not by the abutment of the mobile keeper against the fixed magnetic yoke.

9. An injector according to claim 8, wherein the coil is embedded inside the fixed magnetic yoke.

10. An injector according to claim 1, wherein the actuator is of the electromagnetic type and comprises at least one coil, at least one fixed magnetic yoke, and at least one mobile keeper that is magnetically attracted by the fixed magnetic yoke against the force of a closing spring and is mechanically connected to the mobile needle.

11. An injector according to claim 10, wherein the coil is embedded inside the fixed magnetic yoke.

12. An injector according to claim 10, wherein the mobile keeper of the electromagnet has an annular shape with a smaller diameter than the internal diameter of the corresponding portion of the feeding channel of the supporting body.

13. An injector according to claim 1, further comprising a calibration spring that presses on an end of the mobile needle opposite the shutting head to push the needle itself towards the opening position against a closing spring.

14. An injector according to claim 13, wherein the calibration spring is compressed between the end of the mobile needle opposite the shutting head and a matching body driven in a fixed position.

15. An injector according to claim 14, wherein the matching body has an adjustable position during assembly to adjust an elastic force generated by the calibration spring for calibrating a total elastic thrust acting on the mobile needle.

16. An injector according to claim 13, wherein the calibration spring is inside the balancing channel.

17. A fuel injector comprising:

an injection valve comprising an injection nozzle;

a mobile needle for regulating a fuel flow through the injection valve and ending with a shutting head, the shutting head for engaging a valve seat of the injection valve and being arranged externally with respect to the injection valve and presenting a predetermined sealing diameter;

an actuator for displacing the needle between a closing position and an opening position of the injection valve;

a closing spring which maintains the mobile needle in the closing position of the injection valve, for pushing the shutting head against the valve seat in a sense contrary to a feeding sense of the fuel;

a supporting body having a tubular shape and presenting a feeding channel within which the mobile needle is arranged;

a balancing channel, at ambient pressure, being coupled to the mobile needle and hydraulically isolated from the feeding channel by an elastic diaphragm, the mobile needle having an opposite end to the shutting head that rests on the elastic diaphragm;

a sealing body where the valve seat of the injection valve is defined for fluid-tightly closing the feeding channel; and a stopper component that is integral with the mobile needle and abuts against an upper surface of the sealing body when the mobile needle is in the opening position of the injection valve to determine a stroke length of the mobile needle, wherein the sealing body comprises a disc-shaped capping element that fluid-tightly closes the feeding channel, and a guiding element that elevates from the disc-shaped capping element, the disc-shaped capping element having a tubular shape and accommodates the mobile needle therein, and wherein the stopper element of the mobile needle abuts against an upper surface of the guiding element when the mobile needle is in the opening position of the injection valve.

18. An injector element according to claim 17, wherein the guiding element at least partially presents a lower external diameter with respect to the internal diameter of the feeding channel to define an external channel for the fuel, and wherein the guiding element has in a lower part with a number of through holes leading towards the valve seat.

19. A fuel injector comprising:

an injection valve comprising an injection nozzle;

a mobile needle for regulating a fuel flow through the injection valve and ending with a shutting head, the shutting head for engaging a valve seat of the injection valve and being arranged externally with respect to the injection valve and presenting a predetermined sealing diameter;

an actuator for displacing the needle between a closing position and an opening position of the injection valve;

a closing spring which maintains the mobile needle in the closing position of the injection valve, for pushing the shutting head against the valve seat in a sense contrary to a feeding sense of the fuel;

a supporting body having a tubular shape and presenting a feeding channel within which the mobile needle is arranged;

a balancing channel, at ambient pressure, being coupled to the mobile needle and hydraulically isolated from the feeding channel by an elastic diaphragm, the mobile needle having an opposite end to the shutting head that rests on the elastic diaphragm;

a sealing body where the valve seat of the injection valve is defined for fluid-tightly closing the feeding channel; and a stopper component that is integral with the mobile needle and abuts against an upper surface of the sealing body when the mobile needle is in the opening position of the injection valve to determine a stroke length of the mobile needle, wherein the actuator is of an electromagnetic type and comprises at least one coil, at least one fixed magnetic yoke, and at least one mobile keeper that is magnetically attracted by the fixed yoke against a force of a closing spring and is mechanically connected to the mobile needle, the injector further comprising an axial dimension of an air gap existing between the mobile keeper and the fixed magnetic yoke to always be larger than the stroke length of the mobile needle to ensure that the stroke length is determined by the abutment of the stopper element against the guiding element and not by the abutment of the mobile keeper against the fixed magnetic yoke.

20. An injector according to claim 19, wherein the coil is embedded inside the fixed magnetic yoke.

21. A fuel injector comprising:

an injection valve comprising an injection nozzle;

a mobile needle for regulating a fuel flow through the injection valve and ending with a shutting head, the shutting head for engaging a valve seat of the injection valve and being arranged externally with respect to the injection valve and presenting a predetermined sealing diameter;

an actuator for displacing the needle between a closing position and an opening position of the injection valve;

a closing spring which maintains the mobile needle in the closing position of the injection valve, for pushing the shutting head against the valve seat in a sense contrary to a feeding sense of the fuel;

a supporting body having a tubular shape and presenting a feeding channel within which the mobile needle is arranged and in which fuel is fed at high pressure; and a balancing channel, at ambient pressure to the fuel injector, being coupled to the mobile needle and hydraulically isolated from the feeding channel by an elastic diaphragm, the mobile needle having an end opposite to the shutting head that rests on the elastic diaphragm, wherein the balancing channel presents an internal diameter equal to the sealing diameter of the shutting head and the elastic diaphragm is laterally welded to walls of the balancing channel, the elastic diaphragm having a diameter equal to the sealing diameter of the shutting head.

22. A fuel injector comprising:

an injection valve comprising an injection nozzle;

a mobile needle for regulating a fuel flow through the injection valve and ending with a shutting head, the shutting head for engaging a valve seat of the injection valve and being arranged externally with respect to the injection valve and presenting a predetermined sealing diameter;

an actuator for displacing the needle between a closing position and an opening position of the injection valve;

a closing spring which maintains the mobile needle in the closing position of the injection valve, for pushing the shutting head against the valve seat in a sense contrary to a feeding sense of the fuel;

a supporting body having a tubular shape and presenting a feeding channel within which the mobile needle is arranged and in which fuel is fed at high pressure; and a balancing channel, at ambient pressure, being coupled to the mobile needle and hydraulically isolated from the feeding channel by an elastic diaphragm, the mobile needle having an end opposite to the shutting head that rests on the elastic diaphragm, wherein the balancing channel presents an internal diameter equal to the sealing diameter of the shutting head and the elastic diaphragm is laterally welded to walls of the balancing channel, the elastic diaphragm having a diameter equal to the sealing diameter of the shutting head; and a stopper component that is integral with the mobile needle and abuts against an upper surface of a sealing body when the mobile needle is in the opening position of the injection valve to determine a stroke length of the mobile needle, wherein the stopper element of the mobile needle abuts against an upper surface of a guiding element when the mobile needle is in the opening position of the injection valve.

* * * * *